US007671329B2

(12) United States Patent
Sakata et al.

(10) Patent No.: US 7,671,329 B2
(45) Date of Patent: Mar. 2, 2010

(54) INDUCTIVELY COUPLED PLASMA MASS SPECTROMETER

(75) Inventors: Kenichi Sakata, Tokyo (JP); Noriyuki Yamada, Tokyo (JP)

(73) Assignee: Agilent Technologies, Inc., Santa Clara, CA (US)

( * ) Notice: Subject to any disclaimer, the term of this patent is extended or adjusted under 35 U.S.C. 154(b) by 231 days.

(21) Appl. No.: 11/825,702

(22) Filed: Jul. 9, 2007

(65) Prior Publication Data

US 2008/0035844 A1 Feb. 14, 2008

(30) Foreign Application Priority Data

Aug. 11, 2006 (JP) ..... 2006-219520

(51) Int. Cl.
*H01J 49/12* (2006.01)

(52) U.S. Cl. ..... 250/288; 250/281; 250/282; 250/290

(58) Field of Classification Search ..... 250/281, 250/282, 288, 289
See application file for complete search history.

(56) References Cited

U.S. PATENT DOCUMENTS 4,948,962 A * 8/1990 Mitsui et al. ..... 250/288
5,185,523 A * 2/1993 Kitagawa et al. ..... 250/281
5,308,977 A * 5/1994 Oishi et al. ..... 250/288
5,495,107 A * 2/1996 Hu et al. ..... 250/281
5,519,215 A * 5/1996 Anderson et al. ..... 250/288
6,265,717 B1 * 7/2001 Sakata et al. ..... 250/289
6,936,787 B2 * 8/2005 Tao et al. ..... 219/121.51
2004/0195218 A1 * 10/2004 Tao et al. ..... 219/121.51
2006/0024199 A1 * 2/2006 Tao et al. ..... 422/54
2006/0087651 A1 * 4/2006 Montaser et al. ..... 356/338
2008/0099671 A1 * 5/2008 Sakata et al. ..... 250/288

FOREIGN PATENT DOCUMENTS

JP 10-188877 7/1998
JP 10-208691 8/1998
JP 11-006788 1/1999

* cited by examiner

*Primary Examiner*—David A Vanore
*Assistant Examiner*—Michael Maskell
(74) *Attorney, Agent, or Firm*—Marc Bobys

(57) ABSTRACT

An inductively coupled plasma mass spectrometer comprises a control device 70 for collectively controlling each of the following factors: the amount of liquid drops in the aerosol that is to be supplied to a plasma torch 20, the flow rate of carrier gases 76A and 76B in this aerosol, the RF output of a high-frequency power source 80, and the distance Z between plasma torch 20 and sampling interface 15 and 16.

7 Claims, 6 Drawing Sheets

| Mode | RF output (W) | Z(mm) | Carrier gas total Flow rate (L/mm) | Ce ion sensitivity (standardized) | Ce/CeO sensitivity ratio (x 10-2) |
|---|---|---|---|---|---|
| 1 | 1550 | 5.5 | 1.06 | 0.84 | 1.16 |
| 2 | 1500 | 7.0 | 1.09 | 0.67 | 1.13 |
| 3 | 1500 | 8.0 | 1.09 | 0.54 | 1.01 |
| 4 | 1500 | 8.0 | 1.05 | 0.44 | 0.93 |
| 5 | 1400 | 9.0 | 0.95 | 0.21 | 0.81 |

| Mode | RF output (W) | Z(mm) | Carrier gas total Flow rate (L/mm) | Ce ion sensitivity (standardized) | Ce/Ce0 sensitivity ratio (x 10-13) |
|---|---|---|---|---|---|
| 1 | 1600 | 5.0 | 1.09 | 0.97 | 1.55 |
| 2 | 1600 | 6.0 | 1.11 | 0.86 | 1.33 |
| 3 | 1600 | 7.0 | 1.11 | 0.72 | 1.12 |
| 4 | 1600 | 8.0 | 1.09 | 0.52 | 0.98 |
| 5 | 1600 | 9.0 | 0.05 | 0.33 | 0.82 |
| 6 | 1600 | 10.0 | 0.95 | 0.15 | 0.74 |

| Mode | A | B | C | D | E |
|---|---|---|---|---|---|
| Aerosol-generating gas flow rate (mL/min) | 1.05 | 0.55 | 0.40 | 0.30 | 0.20 |
| Additional diluting gas flow rate(mL/min) | 0.00 | 0.50 | 0.65 | 0.75 | 0.85 |
| Carrier gas total flow rate (mL/min) | 1.05 | 1.05 | 1.05 | 1.05 | 1.05 |
| Volume of sample introduced (mL/min) | 0.33 | 0.33 | 0.17 | 0.17 | 0.17 |
| Sensitivity (standardized) | 1 | 1/2 | 1/4 | 1/10 | 1/20 |

Fig. 5a

| Mode | A | B | C | D | E |
|---|---|---|---|---|---|
| Aerosol-generating gas flow rate (mL/min) | 1.05 | 0.95 | 0.50 | 0.30 | 0.30 |
| Additional diluting gas flow rate(mL/min) | 0.00 | 0.00 | 0.45 | 0.65 | 0.65 |
| Carrier gas total flow rate (mL/min) | 1.05 | 1.95 | 1.95 | 1.95 | 1.95 |
| Volume of sample introduced (mL/min) | 0.33 | 0.33 | 0.33 | 0.17 | 0.07 |
| Sensitivity (standardized) | 1 | 1/2 | 1/4 | 1/10 | 1/20 |

Fig. 5b

| Mode | A | B | C | D | E |
|---|---|---|---|---|---|
| Aerosol-generating gas flow rate (mL/min) | 0.95 | 0.50 | 0.30 | 0.20 | 0.20 |
| Additional diluting gas flow rate(mL/min) | 0.00 | 0.45 | 0.65 | 0.75 | 0.75 |
| Carrier gas total flow rate (mL/min) | 0.95 | 0.95 | 0.95 | 0.95 | 0.95 |
| Volume of sample introduced (mL/min) | 0.33 | 0.33 | 0.17 | 0.17 | 0.07 |
| Sensitivity (standardized) | 1 | 1/2 | 1/4 | 1/10 | 1/20 |

Fig. 5c

INDUCTIVELY COUPLED PLASMA MASS SPECTROMETER

BACKGROUND

1. Field of the Disclosure

The present disclosure relates to technology for an inductively coupled plasma mass spectrometer (ICP-MS), which is a mass spectrometer that uses inductively coupled plasma as the ion source, and in particular, relates to technology for analyzing a high-matrix sample.

2. Discussion of the Background Art

The ICP-MS is known as a high-sensitivity analyzer for detecting traces of metal ions. The basic structure comprises a plasma-generating part for generating plasma from a sample such as a liquid, and a mass-analyzing part for extracting ions from the generated plasma and analyzing these ions.

The plasma-generating part, particularly in the case of a liquid sample, comprises a nebulizer for nebulizing a liquid sample of a certain concentration using a gas having a specific flow rate; a spray chamber for isolating some of the nebulized liquid drops in the form of an aerosol together with an appropriate gas; and a plasma torch such that plasma is generated from the plasma gas and the aerosol is introduced into this plasma.

In further detail, the aerosol is generated by at least some carrier gas being introduced into the nebulizer together with the liquid sample. When this portion of carrier gas blows the liquid sample, the liquid sample is nebulized. The nebulized liquid drops circulate inside the spray chamber. The liquid drops that are relatively large in diameter adhere to the inside walls of the spray chamber and are drained, while only the liquid drops that are relatively small in diameter are transferred toward the plasma torch. In essence, the liquid drops of small diameter, together with the carrier gas for nebulization, form the aerosol and are guided to the plasma torch. The carrier gas is usually an inert gas, typically argon gas.

The plasma torch comprises an inside pipe into which the sample that contains aerosol is introduced and one or multiple outside pipes disposed such that they surround the inside pipe. Auxiliary gas, plasma gas for generating plasma, and the like can be introduced into the outside pipes. Once plasma has been generated by the plasma gas through the operation of a work coil, the aerosol comprising the sample is introduced and as a result, the metal in the sample is ionized and blew out into the plasma.

An interface that faces the generated plasma is disposed at the front end of the mass-analyzing part, which is positioned at the last step of the plasma-generating part. The interface has a two-step structure of a sampling cone and a skimmer cone, and each of these has an orifice for extracting the ions from the generated plasma. Extractor electrodes for extracting the ions in the form of ion beam are disposed at the last step of the interface. The extracted ion beam is introduced into the mass analyzer disposed at the last step and the element is identified due to mass/charge ratio. The analysis results can thereby be obtained in the form of a mass spectrum.

Although well-known throughout industry, an example of the overall structure of an ICP-MS is described in the following JP Unexamined Patent Publication (Kokai) 2000-67804, and the structure of the plasma-generating part is described in JP Unexamined Patent Publication (Kokai) 10-188877. Moreover, JP Unexamined Patent Publication (Kokai) 10-208691 describes technology relating to the use of a plasma-generating part and a mass-analyzing part in combination with one another.

A high-matrix sample is an example of a potential sample to be analyzed by such a device. A "high-matrix sample" is a sample that contains the element to be measured as well as water-soluble substances, such as high concentrations of metal salts. Seawater is an example of a high-matrix sample. When a high-matrix sample is analyzed by conventional methods using conventional devices, there are problems in that, as a result of large amounts of ions being guided to the last step of the device, metal salts and the like are deposited and pollute the surfaces of the sampling cone, skimmer cone, etc., and the orifices become clogged, making analysis impossible. It generally is difficult to analyze a sample in normal mode if the matrix concentration or total dissolved solid (TDS) concentration exceeds 1,000 to 2,000 ppm.

On the other hand, by means of an inductively coupled plasma optical emission spectrometer (ICP-OES), it is possible to analyze even a high-matrix sample having a concentration on the percent order or higher without using a diluting means, which is described later. However, ICP-OES have a disadvantage in that their sensitivity or detection limit is inferior, by three decimal places or more, to inductively coupled plasma mass spectrometers, and it is very difficult to satisfy user requirements for quantitative analysis.

JP Unexamined Patent Publication (Kokai) 8-152408 describes a device comprising an optical measuring device and a mass analyzer for analyzing diverse samples having different matrix concentrations. Nevertheless, the structure of the device described in JP Unexamined Patent Publication (Kokai) 8-152408 is impractical because it is complex and not easy to hold or manipulate, and it does not solve the problem of quantitative analysis.

A single ICP-MS capable of high-sensitivity analysis of liquid samples having a wide range of matrix concentrations would be very effective for practical use. The method whereby a highly concentrated sample that cannot be analyzed directly is diluted to an acceptable extent before aerosol generation is one example. Dilution can be carried out manually or automatically using an autodiluter. JP Unexamined Patent Publication (Kokai) 11-6788 gives an example of a method for diluting a liquid sample using an autodiluter.

Nevertheless, performing dilution by hand takes time. Diluting many samples is an inconvenience in terms of time, and there is also the chance that there will be errors in dilution. On the other hand, using an autodiluter complicates dilution by adding a step for operating additional equipment, and there is the chance that the sample will be contaminated by the outside environment or the tools that are used during dilution of the liquid sample.

An object of the present disclosure is to provide an inductively coupled plasma mass spectrometer with which a user can analyze, continuously and with good reproducibility, samples of various concentrations, including high-matrix samples, without implementing a manual procedure.

SUMMARY OF THE DISCLOSURE

The present disclosure provides an inductively coupled plasma mass spectrometer designed such that an aerosol comprising a carrier gas and liquid drops that contain an analysis sample is introduced into a plasma torch disposed near a work coil connected to a high-frequency power source, a plasma is generated such that it contains the ions of the elements contained in the aerosol, the plasma is projected toward interface having orifices, and at least some of the ions pass and escape through the orifices, this inductively coupled plasma mass spectrometer characterized in that it comprises a control device for comprehensively controlling each of the following conditions: the amount of liquid drops in the aerosol, the flow rate of carrier gas in the aerosol, the RF output of the high-frequency power source, and the distance between the plasma torch and the interface, wherein the sensitivity to the ions to be measured can be set at a specific level by the control device and the ratio of the maximum and minimum sensitivities to the ions to be analyzed is at least 10:1.

The ratio of the minimum and maximum sensitivities to ions can be further increased and can be brought to at least 20:1.

Moreover, preferably, the user can select any of predetermined multiple combinations of conditions of all factors used for the control. Each of the multiple combinations can be determined as a point, on a sensitivity-oxide ion ratio graph, that corresponds to the analysis conditions relating to at least the flow rate of the carrier gas in the aerosol, the RF output of the high-frequency power source, and the distance between the plasma torch and the interface, with this point falling along a single envelope made up of essentially straight lines wherein the metal oxide ion ratio increases in proportion to sensitivity when the oxide ion ratio is at a minimum for each sensitivity. In this case, each point can also be a point within a specific region on the sensitivity-oxide ion ratio graph.

Furthermore, the carrier gas can comprise a first gas used for the generation of the aerosol and a second gas that is mixed with the resulting aerosol, and the control device can determine the amount of liquid drops to be supplied per unit of time by controlling the flow rates of both the first and second gases. In this case, the control device can operate in such a way that the amount of liquid drops to be supplied per unit of time is changed by changing only the ratio of the flow rates of the first and second gases while keeping constant the total flow rate of these gases.

The distance between the plasma torch and interface can be changed by moving either the plasma torch or the interface in the axial direction.

By means of the inductively coupled plasma mass analyzer of the present disclosure, comprehensively appropriate conditions or parameters are determined for all of the above-mentioned conditions, and the amount of ions that pass through the orifices are adjusted by collective control based on these conditions or parameters; therefore, it is possible for a user to continuously analyze samples of various matrix concentrations, including high-matrix samples, without using additional equipment, such as a liquid dilution means, or without the process taking a long time.

In essence, the inductively coupled plasma mass spectrometer of the present disclosure is capable of easily adjusting the amount of ions that will pass through the interface in accordance with samples of various concentrations, ranging from low-matrix concentration to high-matrix concentration; therefore, it is possible to easily analyze a high-matrix sample with good precision, and it is possible to continuously analyze ordinary samples using the same device. By means of the present disclosure, the amount of ions that will pass through the interface is adjusted by a two-step process of dilution, dilution of aerosol flow and dilution in plasma; therefore, even a high-matrix sample with a sufficiently high concentration (for instance, 20,000 to 30,000 ppm) can be analyzed without using another dilution means.

Moreover, by means of the device of the present disclosure, it is possible to set the control conditions under a relatively high plasma temperature at which oxides and other compounds are not produced in the plasma; therefore, it is possible to eliminate the sensitivity-reducing effect caused by matrix, etc. and to analyze even high-matrix compounds with sufficient sensitivity.

Furthermore, by means of the device of the present disclosure, it is possible to add gas after the aerosol has been generated and control the quantity of flow in combination with the gas used during aerosol generation; therefore, it is possible to set control conditions, including the effect of the carrier gas in the aerosol on the plasma, and in particular, to change the liquid drop content of the aerosol without changing the carrier gas total flow rate.

BRIEF DESCRIPTION OF THE DRAWINGS

FIG. 5 presents a table showing an example of how parameters that affect a sample in an aerosol state are set; tables (a) and (c) give examples of settings when the carrier gas total flow is fixed at a predetermined value, and table (b) gives an example of settings that includes a step for changing the carrier gas total flow.

DETAILED DESCRIPTION OF THE PREFERRED EMBODIMENT

Figure 1:
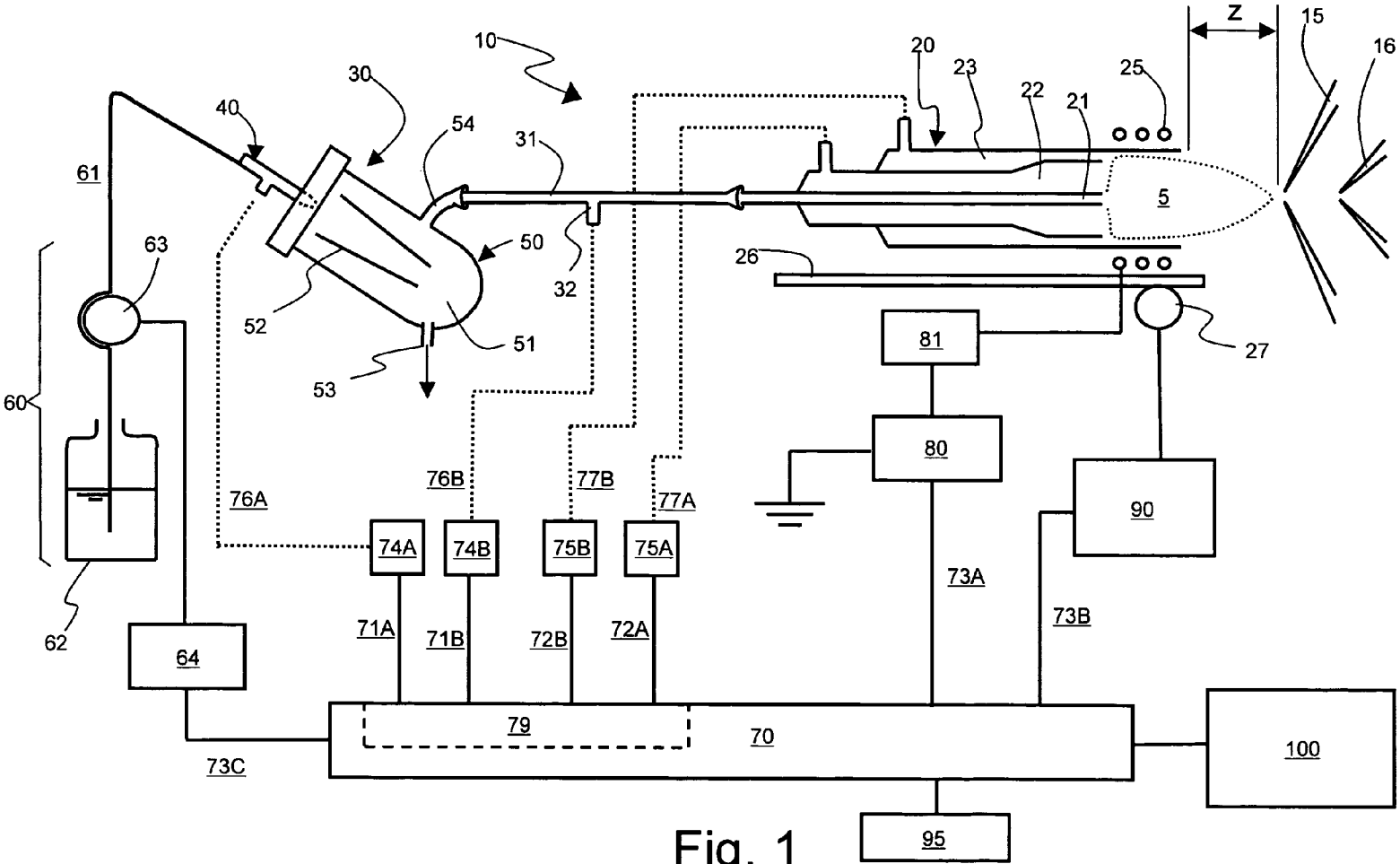
FIG. 1 is a drawing showing the structure surrounding the plasma-generating part of the inductively coupled plasma mass spectrometer of the present disclosure.

The inductively coupled plasma mass spectrometer of a preferred embodiment of the present disclosure will now be described in further detail while referring to the attached drawings. FIG. 1 is a drawing showing primarily the plasma-generating part of the body of the inductively coupled plasma mass spectrometer of the present disclosure. It also shows the structure of the control system in combination with each element. It should be noted that the term "dilution" in the description of the mode of operation of the present disclosure includes all means by which the amount of sample ions that pass through the interface part can be reduced, and in places other than the description of the prior art, also refers to so-called "dry" dilution by which a liquid is not used.

As previously described, this type of inductively coupled plasma mass spectrometer comprises a mass-analyzing part at the last step of the plasma generating part. FIG. 1 shows only a sampling cone 15 and a skimmer cone 16 of the mass-analyzing part, and these parts are at the front thereof and form the interface part that acts to isolate the ion beam. Although not illustrated, the ion beam that is led toward the back of skimmer cone 16 are guided to the mass spectrometer that is positioned farther back. The ion beam is thereby separated based on their mass-charge ratio, and the element is identified.

The primary structural elements of a plasma-generating part 10 are an aerosol-generating means 30 and a plasma torch 20. Aerosol-generating means 30 comprises a nebulizer 40 for nebulizing a liquid sample and a spray chamber 50 for circulating the nebulized liquid sample and isolating only the liquid drops that are relatively small in diameter.

A liquid sample 61 and a gas 76A for generating the aerosol are fed to nebulizer 40. Liquid sample 61 can be nebulized by blowing gas 76A at a specific flow rate onto liquid sample 61. An inert gas, typically argon gas, is used to generate the aerosol. Control of the amount of gas supplied is discussed later.

Liquid sample 61 is fed by liquid sample control means 60. Liquid sample control means 60 comprises a vessel 62 in which the liquid sample is stored and a peristaltic pump 63 disposed at a position along the piping. Peristaltic pump 63 is controlled by a control part 64. In essence, control part 64 controls peristaltic pump 63 in such a way that the pump supplies the necessary amount of liquid sample 61 from vessel 62 to nebulizer 40.

Spray chamber 50 houses a chamber 51 through which the nebulized liquid drops are capable of circulating. A cylindrical wall 52 is formed inside chamber 51 such that gas flows in the opposite directions inside and outside the wall 52. The nebulized liquid drops are transported by the gas flow. However, the liquid drops that are relatively large in diameter adhere to the inner wall surface of chamber 51 and are discharged through a drain 53. The liquid drops of a relatively small diameter are emitted as aerosol through a connecting opening 54 in the direction of a connecting pipe 31.

Aerosol is fed through connecting pipe 31 to plasma torch 20. It should be noted that an inlet 32 for an additional diluting gas 76B that is added for dilution is disposed in the middle of connecting pipe 31. The effect of additional diluting gas 76B is discussed later.

Plasma torch 20 comprises first and second outside pipes 22 and 23 on the outside of an inside pipe to which aerosol is introduced. An auxiliary gas (or a middle gas) 77A is introduced into first outside pipe 22, and a plasma gas 77B is introduced into outermost second outside pipe 23. A work coil 25 is disposed at the tip of plasma torch 20. Work coil 25 is connected to a high-frequency power source (RF power source) 80 via a matching box 81.

Work coil 25 provides plasma torch 20 with the energy for generating a plasma 5. It is possible to bring plasma 5 to an ignited state by turning on high-frequency power source 80 after auxiliary gas 77A and plasma gas 77B have been supplied to plasma torch 20. Then the aerosol containing the liquid drops of liquid sample is supplied from inside pipe 21 in order to analyze the sample. As a result, the elements present in the liquid drops of the aerosol are ionized in plasma 5.

It is possible to increase or decrease the number of ions that pass through interface 15 and 16 by changing the output of high-frequency power source 80. It is possible to reduce the number of ions that pass through interface 15 and 16 by raising the output of high-frequency power source 80 under the specific conditions described later in relation to the oxide ion-ratio graph.

By means of the present embodiment, plasma torch 20 is anchored on a table 26, which can be moved by a drive mechanism 27, such as a motor. As a result, plasma torch 20 can be moved along the direction of introducing aerosol. This adjusts the distance Z between plasma torch 20 and interface 15 and 16 (sampling depth). An X-Y stage is typically used as table 26. Drive mechanism 27 is controlled by a control part 90. FIG. 1 shows only plasma torch 20 anchored to table 26, but it is possible to anchor to the table, in addition to plasma torch 20, other parts of the system that include spray chamber 50 and nebulizer 40, such that these parts can be moved by drive mechanism 27, too.

In general, the amount of ions that pass through interface 15 and 16 shows a tendency toward increasing as the distance Z between the two becomes shorter, and the amount of ions that pass through shows a tendency toward decreasing as distance Z becomes longer. Consequently, it is possible to adjust the number of ions that pass through interface 15 and 16 by adjusting distance Z between the plasma torch 20 and the interface.

One characterizing feature of the present disclosure is that it is possible to easily and with good reproducibility dilute the liquid sample, such as a high-matrix sample, by appropriately controlling both the carrier gas that forms the aerosol and the plasma comprising ions of the metal that is contained in the aerosol. In essence, by means of the control system of the present disclosure, a time-consuming diluting process using a liquid is unnecessary and the procedure that must be conducted by a user is very simple. The effect of the control system of the present embodiment will now be described.

The inductively coupled plasma mass spectrometer of the present embodiment comprises a control device 70, a memory 95 connected to the control device, and a user interface 100. Control device 70 is designed such that control signals 73A, 73B, and 73C are sent to control part 90 for controlling high-frequency power source 80 and drive mechanism 27, and control part 64 for controlling peristaltic pump 63 for supplying liquid sample 61. Furthermore, control device 70 also comprises a gas control part 79 for controlling gas.

Gas control part 79 can send control signals 71A, 71B, 72A and 72B to gas flow rate control devices 74A, 74B, 75A, and 75B. Control signals 71A and 71B determine the amount of aerosol-generating gas 76A and additional diluting gas 76B to be fed to the respective gas flow rate control devices 74A and 74B, and control signals 72A and 72B determine the amount of auxiliary gas 77A and plasma gas 77B to be fed to gas flow rate control devices 75A and 75B.

Control device 70 can comprise one or multiple ICs. Moreover, control device 70 can be designed as a computer having a display that is obtained by combining, as one unit with or separate from, user interface 100. Memory 95 can be designed as a memory that can be written over. It is shown memory 95 is connected to the control device in FIG. 1, but it can also be designed such that it is connected with user interface 100.

The memory 95 is an example of a computer readable medium. A computer readable medium can be a single medium or multiple media as is understood by those in the art. The computer readable medium can be designed as the type that can be written over and can be connected to or combined with the control device 70 for providing instructions to the control device 70.

Gas control part 79 can control the spectrometer in such a way that dilution is performed in an aerosol state. As shown in the drawing, it is possible to add additional diluting gas 76B to the aerosol transferred from spray chamber 50 and reduce the ratio of liquid drops of liquid sample to the total amount of carrier gas. When dilution in the aerosol step is not necessary, such as in the case of analysis of a low-matrix sample, only aerosol-generating gas 76A serves as the carrier gas for the aerosol. On the other hand, in the case of analysis of a high-matrix sample, it is possible to dilute the aerosol by adding additional diluting gas 76B. In the latter case, both the aerosol-generating gas and the additional diluting gas serve as the carrier gas.

In essence, by means of the present disclosure, the ratio of liquid drops contained in the aerosol that reaches plasma torch 20 and the flow rate of the carrier gas can be determined comprehensively but on a one-to-one basis by controlling the amount of liquid sample 61 to be fed via control signal 73C and by controlling the flow rate of aerosol-generating gas 76A and additional diluting gas 76B via control signals 71A and 71B.

Therefore, when recording the relationship of the liquid drop content ratio in the aerosol with the flow rate of aerosol-generating gas 76A and/or the amount of liquid sample fed, it is possible to numerically convert the degree to which the aerosol is diluted by adding the flow rate of the diluting additional gas 76B to the flow rate of the carrier gas. This numerical conversion is an effective means for guaranteeing a good reproducibility of dilution.

Performing controllable dilution after aerosol generation is also effective in terms of controlling the plasma 5, which is discussed later. When there is no means for feeding additional diluting gas 76B, the liquid drop content is changed by reducing the amount of aerosol-generating gas fed during aerosol generation, which should reduce the amount of the sample, and the total flow as carrier gas is also reduced by approximately the same ratio as the sample amount is reduced. As a result, the extent to which plasma 5 generated by plasma torch 20 is cooled by the carrier gas of the aerosol is reduced. In this case, it eventually becomes very difficult to control with good precision the amount of ions that pass through interface 15 and 16.

Even if the amount of aerosol-generating gas that is supplied has been reduced, the device of the present disclosure makes it possible to add the appropriate amount of additional diluting gas. Therefore, it is possible to feed to plasma torch 20 an aerosol that is different only in terms of the liquid drop content without changing the flow rate of carrier gas in the aerosol and thereby guarantee sufficient reproducibility of the analysis results.

The fundamental data for controlling each gas by gas control part 79 can be directly input using user interface 100, or it can be pre-stored in memory 95. Although not illustrated, user interface 100 can comprise an input device and a display for displaying input and control status, and similar operations.

Figure 2:
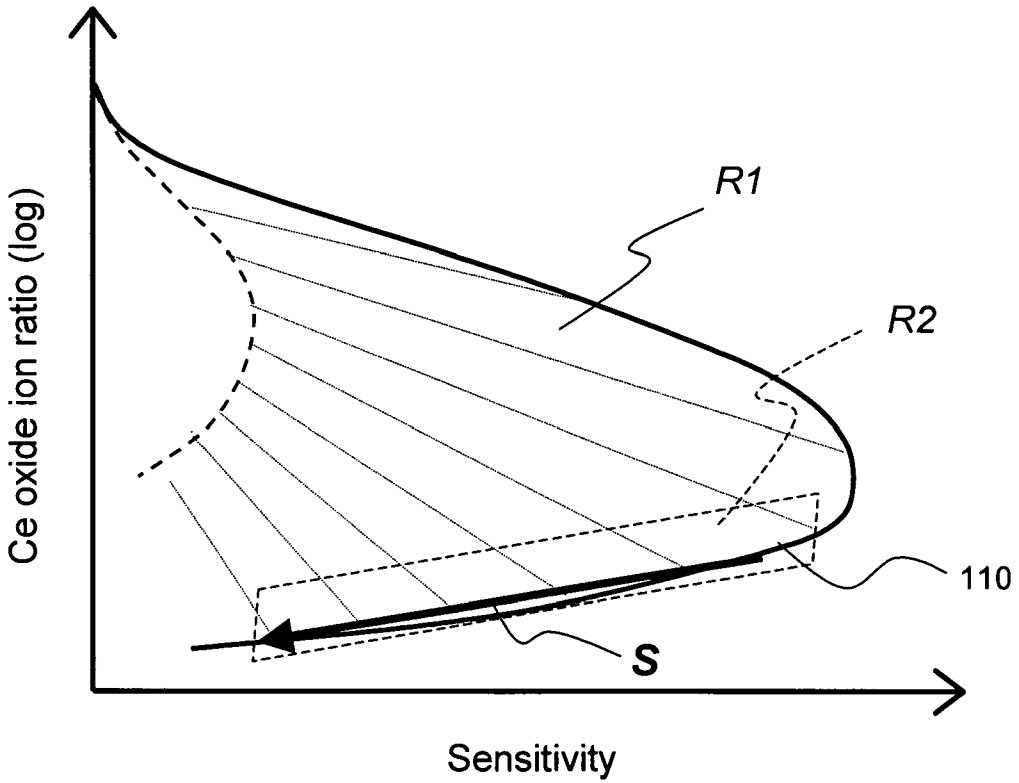
FIG. 2 is a graph showing the so-called sensitivity-oxide ion ratio property.

FIG. 2 is a graph showing the so-called sensitivity-oxide ion ratio property that is referred to in order to determine the control factors of the present disclosure. This graph of the sensitivity-oxide ion ratio shows the detection sensitivity for a specific ion on the x axis, and the oxide ion ratio of the ion in question on the y-axis represented as a logarithm. The region enclosed by the curved lines in the figure shows the distribution of measurement points when the above-mentioned factors, in essence, the carrier gas flow rate, the high-frequency power source output, and the distance Z between the plasma torch and interface, are changed as variable parameters. By means of the present embodiment, Ce (cerium) is used as the specific ion, but it is also possible to use Ba (barium) or La (lanthanum). Moreover, the indicator is not limited to the oxide ion ratio and can be a ratio of sensitivity for ions and another compound that is an indicator of a physical phenomenon as represented by the present disclosure.

By means of the present disclosure, control is possible by providing that the control parameters can be constantly regulated. This regulation capacity is derived from the sensitivity-oxide ion ratio. As illustrated, the measurement points are distributed within region R1 sandwiched between the two curved lines. By means of the present disclosure, each of the above-mentioned parameters is set such that they become points along arrow S when positioned at the bottom of an outside envelope 110. In other words, by means of the present disclosure, all of the factors controlled by the control device are set such that, on the sensitivity-oxide ion ratio curve showing the relationship between the sensitivity for a specific metal ion and oxide ions of the metal ion, they conform to conditions that are found along the envelope wherein the log of the oxide ion ratio is virtually proportional to sensitivity when the oxide ion ratio is at virtually the minimum for each sensitivity.

In essence, by means of the device of the present disclosure, it is possible to change only the amount of liquid drops without changing the total flow rate of carrier gas in the aerosol that is supplied, and it is possible to change the carrier gas flow rate without changing the amount of liquid drops supplied per unit of time. In the latter case, the plasma temperature and plasma status change in accordance with the flow rate of the carrier gas.

Nevertheless, when the plasma temperature is particularly low, the matrix element bonds with other elements so that it is not in pure element ion state and interference is produced that becomes an impediment to analysis of the element to be measured. This state is undesirable when unintentionally produced, particularly when the object is analysis of a specific element. Therefore, whether the total flow rate of carrier gas is low or high, the above-mentioned parameters are set such that temperature of the plasma (particularly the gas temperature) does not fall. For example, in the case of the present embodiment it is possible to determine a point corresponding to a combination of control parameters as a point on the inside of region R2, which is demarcated by a predetermined oxide ion ratio and sensitivity as shown by the parallelogram in the graph in FIG. 2. The region can be determined by a variety of methods, such as satisfying a specific numerical relationship, or setting a specific numerical range.

By using this parameter setting method, it is possible to maintain a relatively high gas temperature during analysis, and to prevent negative effects on analysis precision as a result of the element to be measured forming other compounds, whether the flow rate of the carrier gas is relatively low, or vice-versa, the flow rate of carrier gas has been increased for dilution, as will be discussed later.

As previously mentioned, when the variable parameters are determined by direct input by a user, it is possible to reject the use of the input value if the input value is outside a predetermined range (for instance, outside region R2 in FIG. 2). In essence, for instance, if user interface 100 determines that an input parameter is inappropriate after parameters have been input in succession, it is possible to reject the parameter, or another possible example is the use of an alarm once all of the parameters have been input. On the other hand, when the device of the present disclosure is designed such that each variable parameter is pre-stored in memory 95, it is possible to select a group of stored parameters that satisfies the above-mentioned conditions. An example of how parameters are set is described below.

Figures 3A, 3B:
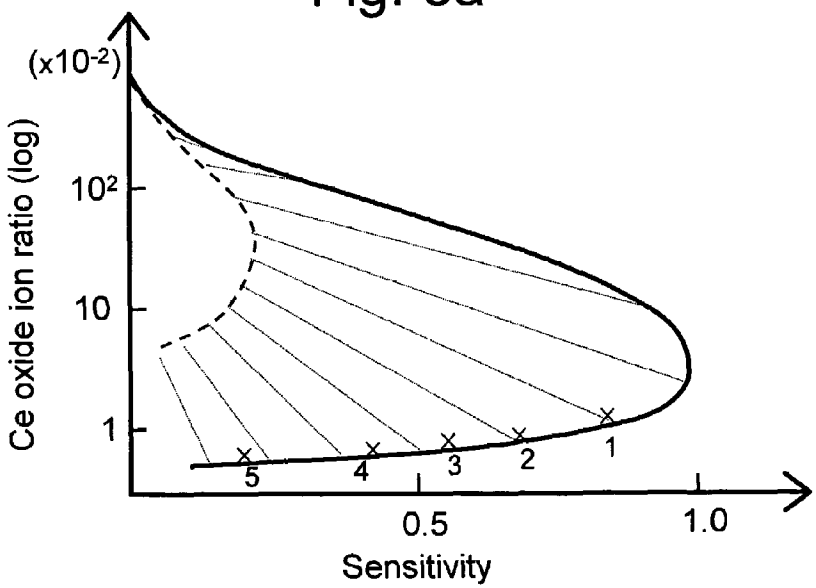
FIG. 3 is a drawing describing how parameters that affect a sample in a plasma state are set; table (a) gives the condition settings of multiple modes that can be selected in accordance with samples of different matrix concentrations, and (b) shows the position on the graph of the sensitivity-oxide ion ratio corresponding to each mode.

FIG. 3 shows the parameters of each condition that affects the sample when in a plasma state, and provides a drawing showing an example of condition settings when these parameters change. Table (a) shows the condition settings of the multiples modes that can be selected in accordance with samples having different matrix concentrations, and (b) shows the position on the graph of the sensitivity-ion oxide ratio corresponding to each mode.

The numbers corresponding to each mode shown in FIG. 3(*a*) can be stored in a readable memory together with each parameter that will affect the aerosol that is discussed later. By means of the present example, the number of modes is 5, although the number can be decreased or vice-versa, the number of modes can be increased. It is even possible to change parameters virtually continuously within a specific range. It should be noted that by means of the present example, carrier gas is fed with the total amount of carrier gas serving as the aerosol-generating gas, and the amount of liquid sample supplied by the peristaltic pump is also constant.

In the table shown in FIG. 3, mode 1 is on the high-sensitivity side and mode 5 is on the low-sensitivity side. In essence, a low-matrix sample is analyzed using the modes beginning from mode 1, while a high-matrix sample is analyzed using the modes beginning from mode 5. When attention is focused on the sensitivity for cerium ions in the table, it is clear that a sensitivity ratio exceeding 4:1 is manifested between mode 1 and mode 5.

On the other hand, according to FIG. 3(*b*), the points corresponding to each mode are points along the envelope at the bottom of the sensitivity-oxide ion ratio graph. Consequently, as previously mentioned, the detrimental effects of oxides, and the like on the analysis results can be minimized in each mode.

Figures 4A, 4B:
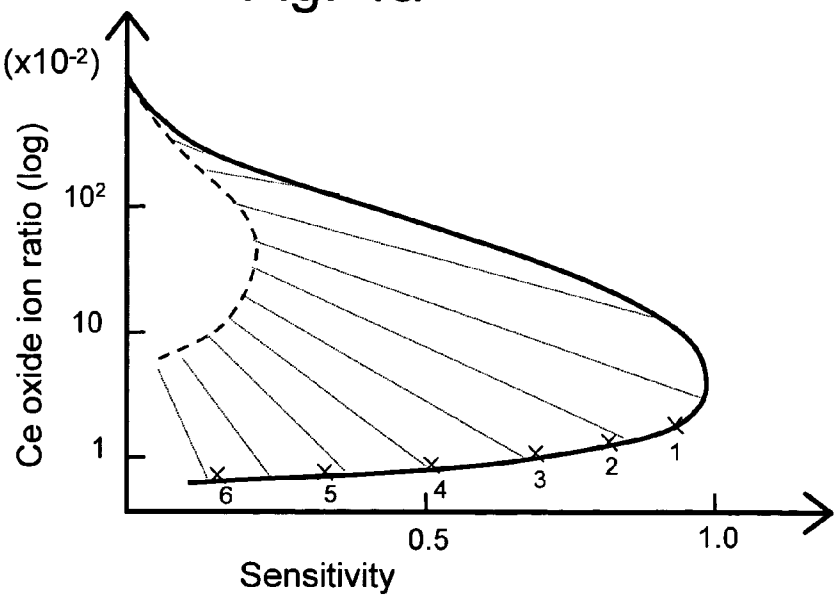
FIG. 4 presents a table and a drawing similar to FIG. 3 showing the parameter settings when the output of the high-frequency power source is fixed.

FIG. 4 shows another example of how parameters are set. Table (a) shows the condition settings of the multiple modes that can be selected in accordance with samples having different matrix concentrations, and (b) shows the position on the graph of the sensitivity-ion oxide ratio corresponding to each mode. By means of the present example, the output of the high-frequency power source (RF output) is constant, as shown in (a), and a difference in sensitivity is realized by changing the other parameters.

As in FIG. 3, a low-matrix sample is analyzed using the modes beginning from mode 1 in FIG. 4, while a high-matrix sample is analyzed using the modes beginning from mode 6. Comparison of the cerium ion concentration in mode 1, in which maximum sensitivity is obtained, and that in mode 6, in which minimum sensitivity is obtained, reveals that the sensitivity ratio exceeds 4:1 (is at least 6:1 or greater). Moreover, as in FIG. 3, the points corresponding to each mode on the sensitivity-oxide ion ratio graph are points along the envelope at the bottom, as shown in FIG. 4(*b*).

In contrast to the fact that FIGS. 3 and 4 present tables showing the condition settings of parameters that affect a sample in a plasma state, FIG. 5 presents tables showing an example of condition settings of parameters that affect a sample in an aerosol state. For instance, when the sample to be analyzed is a low-matrix sample, it is not known whether it is necessary to dilute the aerosol emitted from the spray chamber, but when the sample to be analyzed is a high-matrix sample, diluting gas is added to the aerosol, and there may even be cases in which further dilution is required. Each table in FIG. 5 shows the extent of aerosol dilution in accordance with the amount of diluting gas added.

Three types of settings are shown in FIG. 5. Table (a) is an example of settings wherein the carrier gas total flow rate was fixed at 1.05 mL/minute, table (b) is an example of settings including a step wherein the carrier gas total flow rate was changed from 1.05 mL/minute to 0.95 mL/minute, and table (c) is an example of settings wherein the carrier gas total flow rate was fixed at 0.95 mL/minute. These settings are examples and a variety of other settings are possible.

The important point is that once the carrier gas flow rate has been set by the method illustrated in FIGS. 3 and 4, the carrier gas flow rate is affected such that the aerosol dilution is multiplied. In essence, when determining the extent of dilution, first the appropriate extent of dilution is determined for parameters that affect the plasma shown in FIGS. 3 and 4 and then the parameters that affect the aerosol are determined from the table shown in FIG. 5 by multiplying by the first extent of dilution.

A specific example is the interaction between parameters that affect the plasma shown in FIGS. 3 and 4 and parameters that affect the aerosol shown in FIG. 5. For instance, in mode 4 shown in FIG. 3(*a*), the total flow rate of carrier gas is 1.05 mL/minute, and of the series of mode settings, sensitivity is approximately half that of mode 1, which has the maximum sensitivity. This means that the amount of sample ions that pass through the interface is reduced by approximately half by changing only the parameters that affect plasma.

In this case, further dilution is possible by appropriately selecting the parameters shown in FIG. 5. As previously described, the carrier gas total flow rate is 1.05 mL/minute in each of the series of modes shown in FIG. 5(*a*). Therefore, dilution can be performed whereby in mode 4 in FIG. 3(*a*), the system is initially set at mode A in FIG. 5(*a*), and then sensitivity is changed by ½, in essence, the amount of sample ions that pass through the interface is changed by ½, by staying in mode 4 but changing the mode in FIG. 5(*a*) to mode B, and as a result, it is possible to dilute the sample to ¼ the maximum dilution.

In another case it is possible to change both of these modes. For instance, by changing from mode 4 to mode 5 in FIG. 3(*a*), it is possible to change dilution from approximately 12 that of mode 1 to approximately ¼. In this case, the carrier gas total flow rate changes from 1.05 mL/minute to 0.95 mL/minute. Therefore, in Table 5, a mode change corresponding to such a mode change is selected from the tables in FIG. 5.

For instance, using the series of modes in FIG. 5(*b*), once the initial setting has been brought to mode A where the carrier gas total flow rate is 1.05 mL/minute, it changes to mode B where the total carrier gas flow rate is 0.95 mL/minute to meet the change from mode 4 to mode 5. As a result, a dilution of approximately ⅛ can be accomplished by multiplying a dilution of approximately ¼ through selection of mode 5 by a dilution of approximately ½ by selection of mode B.

As previously described, a variety of dilutions are possible by changing the parameters that affect the plasma in conjunction with the parameters that affect the aerosol. Both have different physical effects on the sample and therefore, the appropriate parameter settings can be selected in accordance with the sample to be analyzed. The parameters in the tables shown in FIGS. 3 through 5 are for illustration, and a variety of different dilution conditions can be provided by storing many parameters in the memory and reading these parameters as necessary.

When use is limited and more than certain necessary types of combinations of parameters are not needed, it is possible to predetermine several types of combinations of parameters that will affect the plasma and parameters that will affect the aerosol, store only these in memory 95, and read these combinations.

Figure 6:
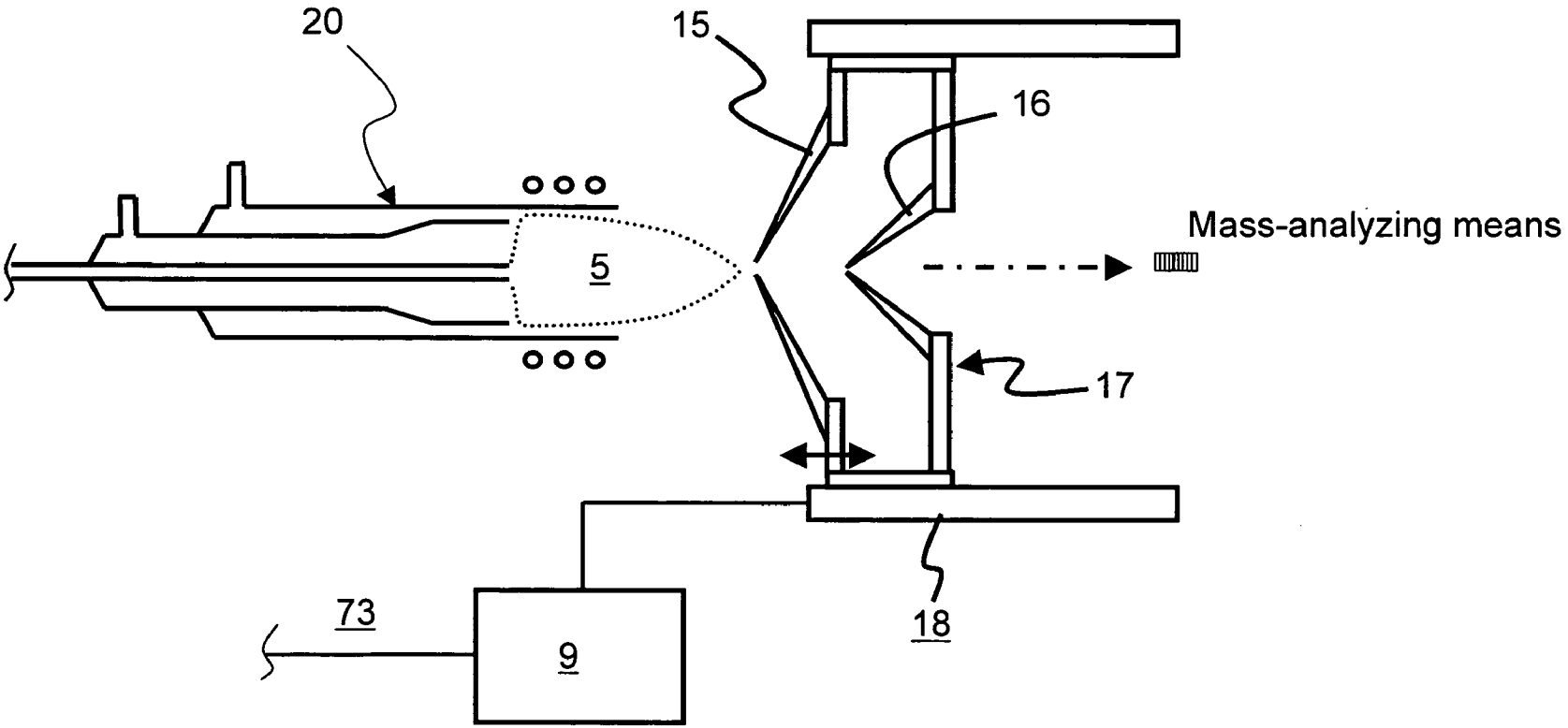
FIG. 6 is a drawing describing other means for changing the sampling depth Z.

FIG. 6 is a drawing describing an embodiment that is a modified version of FIG. 1, and shows other means for changing the sampling depth Z. As previously described, in the embodiment in FIG. 1, interface 15 and 16 are stationary, and plasma torch 20 can move relative to interface 15 and 16. In the embodiment in FIG. 6, on the other hand, plasma torch 20 is stationary, and interface 15 and 16 can move with respect to plasma torch 20.

As shown in FIG. 6, sampling cone 15 and skimmer cone 16 are a single unit, and this unit 17 is guided by a guide means that is not illustrated such that it can move within a frame 18. For instance, a drive mechanism that is not illustrated is disposed on the side of frame 18 and this drive mechanism is controlled by a control part 91. It should be noted that the pressure is reduced between sampling cone 15 and skimmer cone 16, and pressure is further reduced to a high vacuum in the last step of skimmer cone 16. However, these means are not shown in FIG. 6.

The above-described examples are preferred working examples of the present disclosure, but it goes without saying that they are only examples and in no way limit the present disclosure. Various modifications and changes by persons skilled in the art are possible.

What is claimed is:

1. An inductively coupled plasma mass spectrometer designed such that an aerosol comprising a carrier gas and liquid drops containing an analysis sample is introduced into a plasma torch disposed near a work coil connected to a high-frequency power source, a plasma is generated such that it contains the ions of the elements contained in the aerosol, the plasma is projected toward interface having orifices, and at least some of the ions pass and escape through the orifices, said inductively coupled plasma mass spectrometer comprising:

a control device for comprehensively controlling conditions of the inductively coupled plasma mass spectrometer according to instructions in a computer readable medium;

the computer readable medium containing the instructions for instructing the control device to comprehensively control each of the following conditions: the amount of liquid drops in the aerosol, the flow rate of carrier gas in the aerosol, the RF output of the high-frequency power source, and the distance between the plasma torch and the interface, wherein the sensitivity to the ions to be measured can be set at a specific level by the control device and the ratio of the maximum and minimum sensitivities to the ions to be analyzed is at least 10:1; and wherein the computer readable medium further contains instructions for instructing the control device to determine at least the flow rate of carrier gas in the aerosol, the RF output of the high-frequency power source, and the distance between the plasma torch and the interface such that the points corresponding to the analysis conditions on a sensitivity/oxide ion ratio graph showing the relationship between sensitivity to a specific metal ion and oxide ions of the metal ion are positioned along an envelope wherein the log of the ratio of oxide ions forms a virtually proportional relationship with sensitivity when the oxide ion concentration at each sensitivity has been brought to virtually a minimum.

2. The inductively coupled plasma mass spectrometer according to claim 1, wherein the computer readable medium further contains instructions for instructing the control device to determine at least the conditions of the flow rate of carrier gas in the aerosol, the RF output of the high-frequency power source, and the distance between the plasma torch and interface such that the points corresponding to the analysis conditions are positioned within a specific region on the sensitivity/oxide ion ratio graph.

3. The inductively coupled plasma mass spectrometer according to claim 1, wherein said carrier gas comprises a first gas used for generation of the aerosol and a second gas that is added and mixed after the aerosol has been generated, and the computer readable medium further contains instructions to control the control device to control the liquid drop content of the aerosol by controlling the flow rates of the first and second gases.

4. The inductively coupled plasma mass spectrometer according to claim 3, wherein said ratio of the maximum and minimum sensitivity at each position along the envelope is at least 4:1 at condition settings under which there is no change in the amount of second gas.

5. The inductively coupled plasma mass spectrometer according to claim 4, wherein the computer readable medium further contains instructions to control said control device such that the amount of liquid drops to be supplied per unit of time to the plasma torch is changed by changing the ratio of the flow rates of the first and second gases while keeping constant the total flow rate of these gases.

6. The inductively coupled plasma mass spectrometer according to claim 5, wherein the computer readable medium further contains instructions to control said control device to bring the ratio of the maximum and minimum amounts of liquid drops to be supplied per unit of time to the plasma torch to at least 5:1 by changing only the ratio of the flow rates of the first and second gases while keeping constant the total flow of these gases.

7. The inductively coupled plasma mass spectrometer according to claim 1, wherein the computer readable medium further contains instructions to change the distance between the plasma torch and the interface by moving either the plasma torch or the interface in the axial direction.

* * * * *